United States Patent [19]

Gegere

[11] Patent Number: 4,834,058

[45] Date of Patent: May 30, 1989

[54] PELLET-FIRING TOY GATLING GUN

[75] Inventor: Michael A. Gegere, 1020 Bartlett Dr., Vista, Calif. 92084

[73] Assignees: John O. Beckwith, Encinitas; Michael A. Gegere, Vista, both of Calif.

[21] Appl. No.: 933,240

[22] Filed: Nov. 21, 1986

[51] Int. Cl.[4] ..... F41C 17/00

[52] U.S. Cl. ..... 124/29; 124/39; 124/48; 124/41 C

[58] Field of Search ..... 273/29, 39, 48, 83, 273/59, 45, 27, 31, 26; 124/29, 39, 48, 83, 27

[56] References Cited

U.S. PATENT DOCUMENTS

| | | | |
|---|---|---|---|
| 36,836 | 11/1862 | Gatling | 89/12 |
| 1,328,929 | 1/1920 | McDaniel | 124/39 |
| 1,353,696 | 9/1920 | Abramowitz | 124/39 |
| 1,360,410 | 11/1920 | Jones | 124/39 |
| 2,837,078 | 6/1958 | Daniel | 124/48 |
| 3,726,266 | 4/1973 | Palmer | 124/48 |
| 3,729,853 | 5/1973 | Critcher | 124/48 |

*Primary Examiner*—Richard C. Pinkham
*Assistant Examiner*—T. Brown
*Attorney, Agent, or Firm*—Baker, Maxham, Jester & Meador

[57] ABSTRACT

A pellet-firing toy gatling gun includes a rotatable multiple barrel assembly with a number of barrels arranged in a substantially circular array that is rotated such that each barrel passes a predetermined firing position one time during each rotation of the barrel assembly. A firing mechanism positions a spherical pellet at the firing position and propels the pellet through a barrel in response to a cocking and firing actuation sequence. An actuating mechanism acts between the rotatable barrel assembly and the firing mechanism in response to rotation of the barrel assembly by effecting the cocking and firing actuation sequence in synchronism with rotation of the barrel assembly.

9 Claims, 3 Drawing Sheets

PELLET-FIRING TOY GATLING GUN

BACKGROUND OF THE INVENTION

This invention is in the field of toys and relates particularly to a pellet-firing toy gun of the gatling type.

Toy guns which simulate the operation of authentic weapons are well known. Perhaps the most popular of the toy guns is the now-classic "B-B" gun which, by a pumped pneumatic action, singulates and fires spherical pellets known as "B-B's."

Another example of a toy gun is found in U.S. Pat. No. 3,369,535 of Bonanno, which teaches a facsimile, beltfed machine gun which advances a cartridge into a gun housing fires a projectile from the cartridge, and ejects the cartridge laterally from the housing.

Of great interest to weapons enthusiasts is the historical gatling gun, invented by Richard J. Gatling during the mid-nineteenth century. The gatling gun is notable as the principal precursor of the modern machine gun. A modern form of the gatling gun has even been proposed to provide air defense for large bodies of troops.

To date, while many non-operating models of the gatling gun have been made and collected, no operating, pellet-firing version of this historic weapon has been provided.

It is therefore the general object of the invention to provide an operating toy model of a gatling gun.

A further objective of the invention is to provide a pellet-firing toy gun of the gatling type, adapted to simulate the operation of the original gatling gun.

An important feature of this invention is found in the provision of a firing mechanism which positions and fires spherical pellets through the barrels of a rotating gun barrel assembly in synchronism with the rotation of the assembly.

The pellet-firing toy gatling gun of the invention includes a rotatable barrel assembly with a plurality of substantially parallel barrels disposed in a circular array. The barrel assembly is rotated by a rotating mechanism in such a manner that a barrel is rotated to a predetermined firing position once each revolution of the barrel assembly. A firing mechanism, capable of being cocked, positions a substantially spherical pellet at the firing position and propels the pellet through the barrel in response to a cocking and firing actuating sequence. An actuating assembly connected to the rotatable barrel assembly and to the firing mechanism effects the cocking and firing sequence in synchronism with rotation of the rotatable barrel assembly.

In one embodiment, the firing mechanism is a stationary mechanism adjacent the firing position and has a reciprocated spring-actuated firing member. The firing mechanism has a first state in which the firing member is in an uncocked position, a second state in which the firing member is in a tensioned, cocked position, and a third state in which the firing member is released from the cocked position and driven by the firing mechanism against the spherical pellet. In this embodiment, the actuating mechanism includes a rotatable cam attached to the barrel assembly and a reciprocating cam follower acting between the rotatable cam and the firing mechanism. The cam follower advances the firing mechanism through the first, second, and third states in response to rotation of the cam on the barrel assembly.

In another embodiment, the firing mechanism includes a firing member on the barrel assembly adjacent the barrel, the firing member being movable away from the barrel in a cocking direction to a predetermined firing release point. In this embodiment, the firing mechanism also includes a tensioning assembly which biases the firing member toward the barrel when the firing member is moved in the cocking direction and which drives the firing mechanism against the spherical pellet when the firing member is at the firing release point. In this embodiment, the actuating mechanism includes a stationary cam adjacent the barrel assembly and positioned for engaging and moving the firing member along a partially spiral path and in the cocking direction to the release point.

The achievement of the above-stated goals and the realization of other unstated objectives and advantages of the present invention will become evident when the following detailed description is read in connection with the below-described drawings in which.

DETAILED DESCRIPTION OF THE PREFERRED EMBODIMENTS

Figure 1:
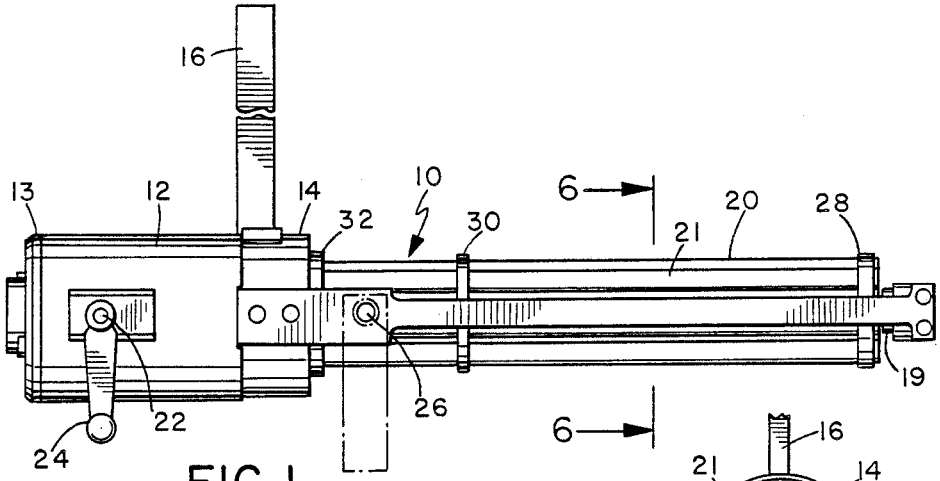
FIG. 1 is a side elevation view of the pellet-firing toy gatling gun.
Figure 2:
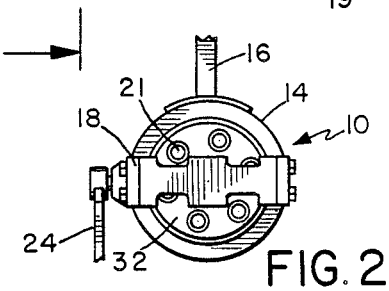
FIG. 2 is a front end view of the toy gun of FIG. 1.
Figure 3:
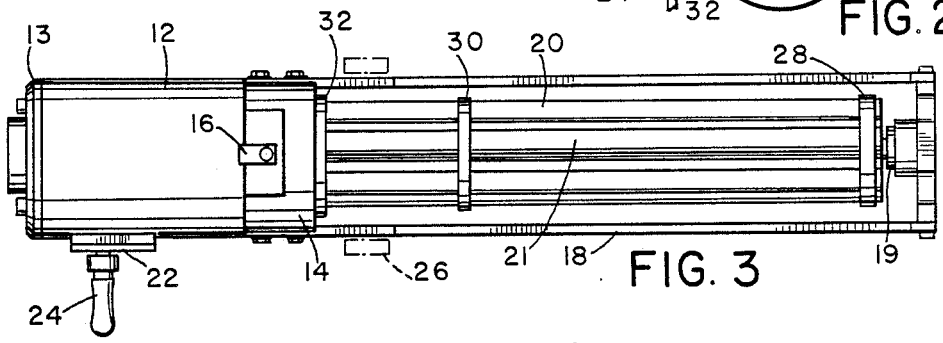
FIG. 3 is a top plan view of the toy gun of FIG. 1.

Refer now to FIGS. 1–3 for general description of the pellet-firing toy gatling gun which constitutes the invention. When used herein, the term "toy" means not only a child's plaything, but also signifies a facsimile or simulation of the weapon known as the gatling gun. In this regard, the term "toy" refers broadly to an operational scale model of a gatling gun, which is intended to appeal to weapon collectors and gun enthusiasts.

Figure 4:
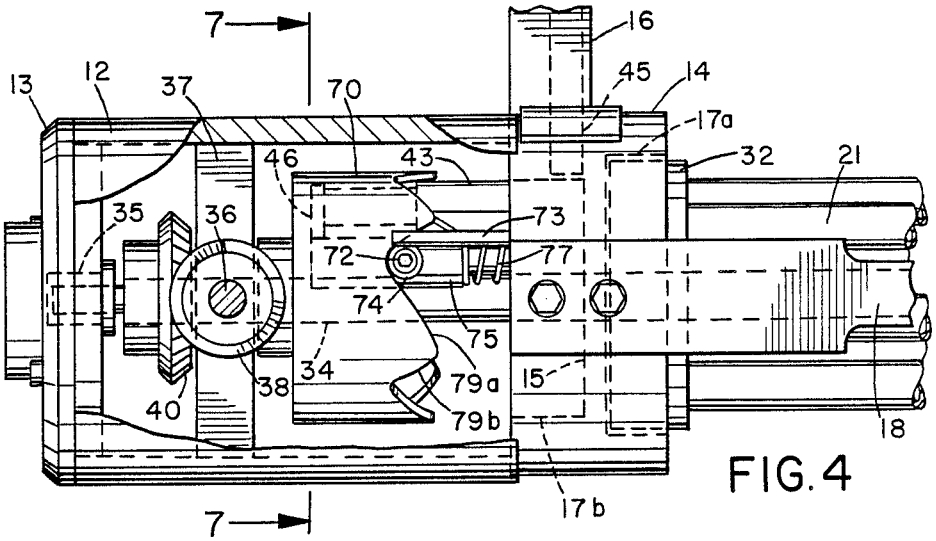
FIG. 4 is an enlarged side elevation view of the Breech assembly of the toy gun, with portions cut away.
Figure 5:
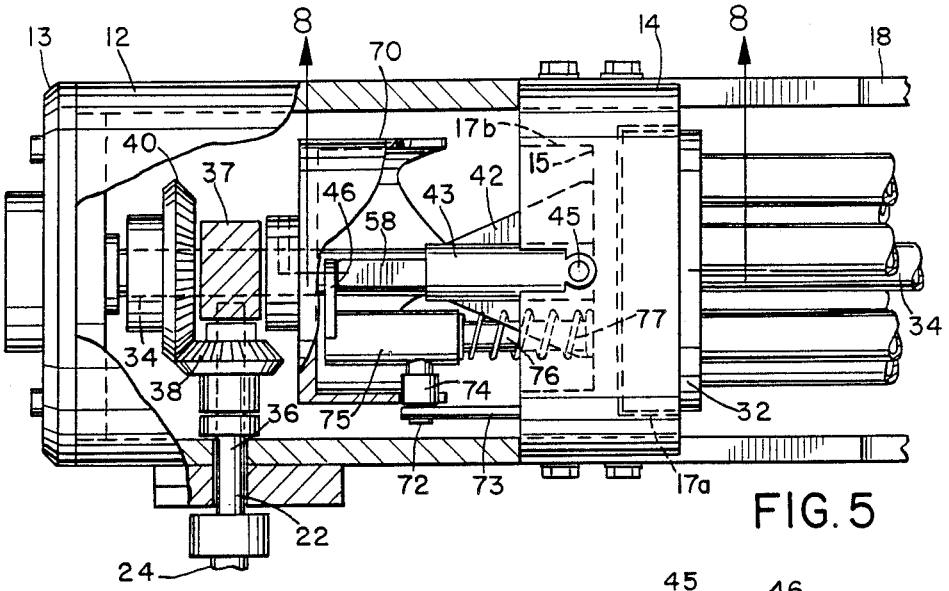
FIG. 5 is a top plan view of the Breech assembly illustrated in FIG. 4, with portions cut away.

The toy gun of the invention is indicated generally by 10 in FIGS. 1–3, and includes a hollow, cylindrical breech 12 whose rear opening is closed by a breech cover 13 and whose forward opening engages a breech block 14. As shown in FIGS. 4 and 5, the breech block includes a web 15, dividing the block into a forward bearing recess 17*a* and a rear recess 17*b*. Although not shown, the breech web 15 is penetrated by a cylindrical bearing channel opening between the forward and rear recesses 17*a* and 17*b*, respectively. A pellet magazine 16 affords a channel for singulating and feeding pellets into the breech block 14. The breech block 14 anchors the rear portion of a support frame 18. The forward portion of the support frame 18 includes a bearing assembly 19. The breech block 14 and support frame 18 rotatably support a rotatable barrel assembly 20 which consists of six barrels, one indicated by 21. Rotation of the barrel assembly 20 is afforded by a geared crank assembly 22 to which rotary power can be provided by, for example, a hand crank 24. As thus far described, the gun 10 can be carried on a support assembly by a pair of trunnions, one indicated by 26, which are formed on a portion of the support frame 18 near the breech block 14.

Figure 6:
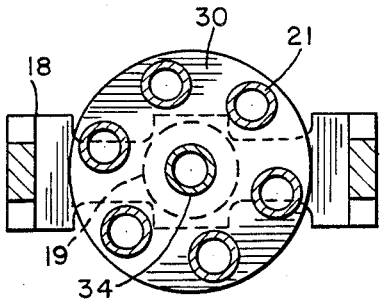
FIG. 6 is an enlarged sectional view taken along line 6—6 of FIG. 1.

The six barrels of the rotatable barrel assembly 20 are supported as a single rotatable unit by a front plate 28, a middle plate 30, and a rear plate 32. The barrel assembly 20 rotates about an axis defined by an axial shaft 34. The axial shaft 34 is journaled at its distal end in the bearing 19, at its proximal end in a bearing 35 in the breech cover 13, and also in the bearing channel, not shown, in the web of breech block 14. The rear plate 32 of the barrel assembly is rotatably supported in the bearing recess 17*a* of the breech block. As shown in FIGS. 2 and 6, the rotatable barrel assembly 20 has the classic gatling configuration in the which the six barrels of the assembly are substantially parallel to one another and disposed in a circular array.

Rotation of the rotatable barrel assembly 20 is afforded by the crank assembly 22. As shown in FIGS. 4 and 5, the crank assembly includes a rotatable shaft 36 which is journaled in a crosspiece 37 attached to the interior of the breech 12. A gear 38 is fixed near the end of the shaft 36 and is in meshed orthogonal engagement with another gear 40. The gear 40 is attached to the rear portion of the axial shaft 34 of the barrel assembly 20. It should be evident that turning the hand crank 24 will rotate the gear 38, which rotation will be transferred by the gear 40 to the axial shaft 34 and to the rotatable barrel assembly 20.

Figure 7:
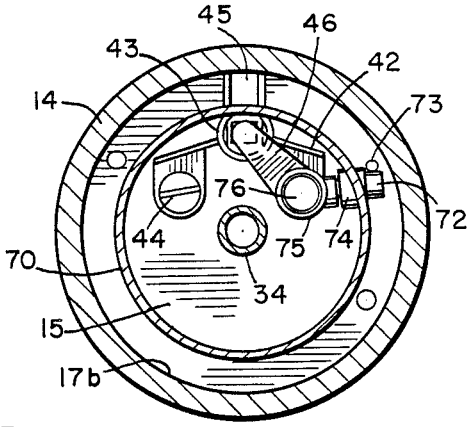
FIG. 7 is a sectional view taken along line 7—7 of FIG. 4.

The toy gatling gun is enabled to fire spherical pellets by a firing assembly which can be understood with reference to FIGS. 4, 5, 7 and 8–12. As shown in FIGS. 4, 5 and 7, a triangular firing mechanism support frame 42 is attached to the rear of the breech block web 15. The frame includes a firing mechanism enclosure 43. As shown in FIG. 7, the support frame 42 is secured in the rear recess 17*b* of the breech block by a pair of screws, one indicated by 44, threaded into the breech block web 15. FIGS. 4, 5, 7 and 8 illustrate clearly a pellet channel 45 that is formed in the breech block 14 and which communicates with the pellet magazine 16 when the magazine is in the position shown in FIG. 1. Also shown in FIGS. 4, 5, 7, 8, 9 and 11, for the purposes of understanding the operation of the firing mechanism is a yoke extension 46.

Figure 8:
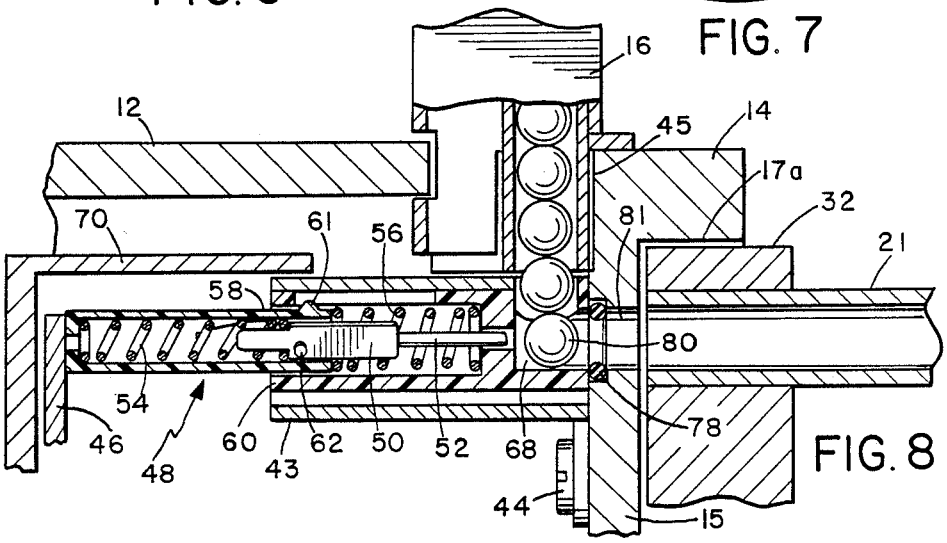
FIG. 8 is an enlarged sectional view taken along line 8—8 of FIG. 5.
Figure 9:
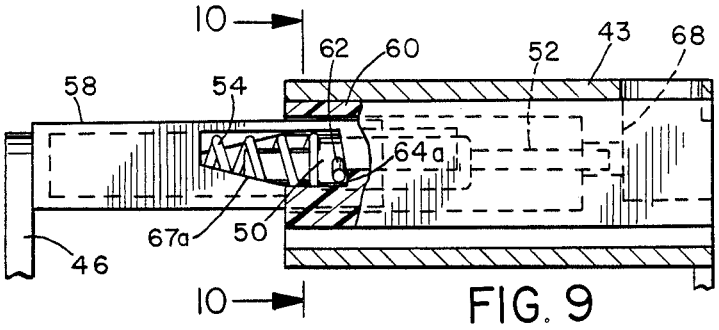
FIG. 9 is an enlarged side elevation view, with portions cut away, of a firing mechanism shown in FIG. 8.
Figure 10:
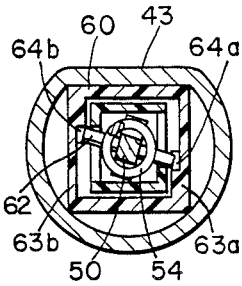
FIG. 10 is a sectional view taken along line 10—10 of FIG. 9, with a firing mechanism in a first state in which a firing member is in an uncocked position.
Figure 11:
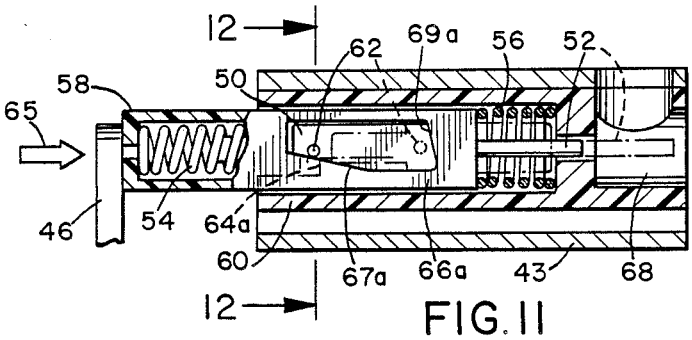
FIG. 11 is a view similar to FIG. 9, with a firing mechanism in a second state in which the firing member is in a cocked position and a third state in which the firing member is released from the cocked position.
Figure 12:
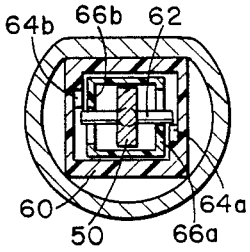
FIG. 12 is a sectional view taken along line 12—12 of FIG. 11.

The firing mechanism 48 is illustrated in FIGS. 8–12. The firing mechanism 48 is a spring-actuated mechanism with a firing member 50 which transitions at its forward end into a firing pin 52. The firing member 50 is reciprocally actuated by a first spring 54 acting against its rear portion and a second spring 56 acting against its forward portion and surrounding the firing pin 52. The springs 54 and 56 are retained against the firing member by a rear casing 58 and a forward casing 60. The rear casing 58 is partially contained in the forward casing 60 and is slidable therein. The rear casing 58 is retained in the forward casing by a stop 61 formed in the forward part of the rear casing which engages a slot, not shown, on the top of the front casing. The firing member is transfixed by a retainer pin 62 which extends through openings in the rear and front casings 58 and 60. As shown most clearly in FIGS. 9–12, the front casing 60 has a pair of cutouts in each of the side walls 63*a* and 63*b*. The cutouts each have shoulders 64*a* and 64*b* toward which the spring 54 urges the firing member 50. The spring 54 also imposes a clockwise bias on the firing member 50, which causes each end of the retainer pin 62 to engage a respective one of the shoulders 64*a* and 64*b*. This retains the firing member and prevents it advancing into the front casing 60. In this configuration, best shown in FIG. 10, the firing mechanism is in a first state where the firing member is in a relatively stable, retained position called the "uncocked" position. Next, as pressure is applied on the rear of the rear casing 58 by the yoke extension 46 in the direction of the arrow 65 in FIG. 11, the spring 54 compresses, increasing the bias exerted by the firing member through the retaining pin 62 against the shoulders 64*a* and 64*b*. In addition, the force moves the rear casing 58 into the front casing 60. As shown in FIGS. 9, 11, and 12, the rear casing 58 also has a pair of sidewalls 66*a* and 66*b*, each with a ramped surface. The ramped surface of the sidewall 66*a* is indicated by 67*a* in FIG. 11. As indicated by FIGS. 10 and 12, as the rear casing 58 is pushed into the front casing 60, it not only compresses the spring 54, but also, by means of the ramps in the sidewalls 66*a* and 66*b*, rotates the firing member 50 counterclockwise when each end of the retainer pin 62 rides up a respective ramp. This counterclockwise motion counters the clockwise rotational bias imposed on the firing member 50 by the spring 54 and ultimately results in each end of the retaining pin 62 clearing the shoulders 64*a* and 64*b*. The ends of the retainer pin 62 are eventually rotated to a point where each end almost clears its respective shoulder on the front casing 60. At this point, the firing mechanism is in a second state, referred to as the "cocked" state in which further counterclockwise rotation of the firing member 50 will cause each end of the retainer pin 62 to clear its respective shoulder. The transition from the cocked state to a third state is achieved when the firing member 50 is rotated enough for the retainer pin 62 to clear the shoulders 64*a* and 64*b*. At this point, the compressed spring 54 will suddenly thrust the firing member forward toward the front casing, thereby driving the firing pin 52 forwardly into a positioning chamber 68 formed in the front casing 60. The firing mechanism is designed to insure that the potential force of the compressed spring 54 and the length of the firing member 50 and firing pin 52 is sufficient to drive the distal tip of the firing pin 52 almost entirely through the chamber 68. As shown in FIG. 8, the chamber 68 communicates with the pellet channel 45 and serves to position a spherical pellet. Thus, when the firing pin 52 is driven forward into the chamber 68, it is driven against a pellet in the chamber. This is indicated by the dashed outline of the firing pin 52 in FIG. 11.

It will be evident that the pellet receiving chamber 68 in the firing mechanism corresponds to a firing position to which one of the barrels of the rotary barrel assembly must be rotated in synchronism with the cocking and release of the firing member 50. When the firing pin 52 is driven into the chamber 68 against the spherical pellet, the pellet will be driven into the barrel from the firing position and conducted down the length of the barrel to exit the gun as a fired pellet.

As will be evident from FIG. 11, when the firing mechanism transitions from the first through the third states, the spring 56 will be compressed between the front interior of the front casing 60 and the outside front of the rear casing 58. Further, the firing member 50 is driven forward within the rear casing 58 until stopped by engagement of either end of the retainer pin 62 against the forward edges of the cutouts in the walls 66*a* and 66*b*. This engagement is shown in FIG. 11 by the discontinuous representation of the retainer pin 62 adjacent the forward edge 69*a* of the cutout in the wall 66*a*. It should be evident that a corresponding edge in the cutout of the wall 66*b* stops the other end of the retainer pin 62. In this condition, when the yoke extension 46 is moved in a direction opposite the arrow 65, releasing the retaining force on the rear of the rear casing 58, the compressed spring 56 will move the rear casing in the same direction. The movement of the rear casing 58 will move the firing member 50 rearwardly out of the front casing 60, while the clockwise rotational bias imposed on the firing member by the spring 54 will rotate it into the position where the shoulders 64*a* and 64*b* once again stop the retainer pin 62. This corresponds to the state one configuration illustrated best in FIGS. 9 and 10.

The firing mechanism is operated in synchronism with rotation of the barrel assembly by an actuating mechanism shown in FIGS. 4, 5, and 7. The actuating mechanism includes an annular cam 70, a cam follower 72, a cam follower stop pin 73, a cam follower roller 74, a cam follower yoke 75, a follower shaft 76, and a cam follower spring 77. The annular cam 70 is attached to the axial shaft 34 of the barrel assembly to rotate therewith when the barrel assembly is rotated. As shown in FIG. 4, the cam 70 has a cam pattern represented by a circumferential contour of the forward edge of the cam. The cam contour works conventionally to impose a reciprocating action on the cam follower 72 which rides on the cam contour by means of the cam follower roller 74. The cam follower is attached to the cam follower yoke which is slidably received on the shaft 76. Although not shown in the drawings, the yoke is retained on the shaft 76 by a slot in the shaft through which an extension of the cam follower fits. Alternatively, the yoke can be retained on the shaft 76 by the annular cam 70.

In operation, the annular cam rotates in the direction out of the bottom and into the top of FIG. 4 so that the cam follower rides up the gradual slope 79*a* of the cam. This moves the cam follower and the attached yoke to the right in FIG. 4 toward the breech block 14. The cam follower and yoke are prevented from torquing upwardly to follow the cam 70 by the cam follower stop pin 73. As the cam follower advances toward the breech block 14, the spring 77 compresses between the yoke 75 and the rear recess 17*b* of the breech block 14. After the cam 70 rotates a sufficient distance, the cam follower follows the relatively sharp downward slope 79*b* and is driven away from the breech block 14 by the compressed spring 77. Thus, as the cam 70 rotates, the cam follower and the attached yoke describe a substantially linear reciprocating path which is parallel to the cam follower stop pin 73 and to the shaft 76. This reciprocating action is transferred to the firing mechanism by means of the yoke extension 46 which is formed on the yoke as shown in FIGS. 4, 5, and 7.

The annular cam 70 is positioned on the axial shaft 34 such that when the cam follower traverses to the peak of the gradual slope 79*a*, one of the barrels is rotated to a point where it is coaxial with the firing mechanism chamber 68; this point is referred to as the firing position. At the firing position, a flexible O-ring 78 retains a pellet in the chamber 68 until the pellet is struck by the firing pin 52. The O-ring 78 then is compressed slightly by the force of the pellet and yields to permit the pellet to be propelled forward out of the chamber 68.

The relative alignment of a barrel with respect to the firing mechanism chamber (and therefore, with respect to the firing point) is illustrated in FIG. 8. FIG. 8 is not a strictly accurate portrayal of the synchronism between the firing mechanism and rotation of the barrel assembly which is imposed by the actuating mechanism, because the barrel 21 is illustrated as being aligned with the firing mechanism chamber 68 when the firing mechanism is actually in its first state. This is for purposes of illustration only, and it is to be understood that the alignment shown between the barrel 21 and the chamber 68 would actually obtain when the firing mechanism transitions from its second to its third state as shown in FIG. 11, which would result in a spherical pellet such as the pellet 80 being driven through the barrel 21 and out of the gun. FIG. 8 also illustrates a transition aperture 81 opening through the web 15 of the breech block for conducting a pellet driven out of the firing mechanism into a barrel.

Thus, the rotation of the cam 70 in conjunction with the turning of the rotatable barrel assembly 20, together with correct positioning of the cam 70 on the axial shaft 34 synchronizes the operation of the firing mechanism with the rotation of the barrel assembly in such a manner that when a pellet is driven from the firing mechanism, it is conducted to a barrel which has been rotated to the firing position.

Figure 13:
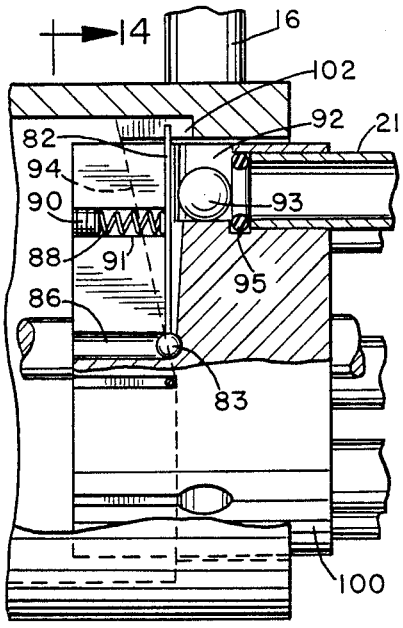
FIG. 13 is a side elevation view, partially cut away, of an alternative firing mechanism.
Figure 14:
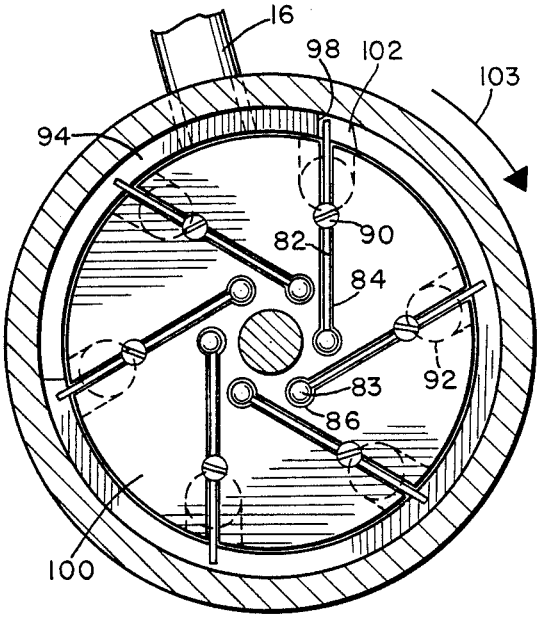
FIG. 14 is a sectional view taken along line 14—14 of FIG. 13.

An alternative embodiment of the firing mechanism is illustrated in FIGS. 13 and 14. In FIG. 13, a rear plate 100 is illustrated which corresponds in function to the rear plate 32 of the rotatable barrel assembly illustrated in FIGS. 1–3. However, in this case, the breech block 14 is an annular cylinder without a web. As shown, the breech block also functions as a bearing for the rear plate 100. A respective firing mechanism is positioned in the rear plate 100 for each of the barrels in the rotatable barrel assembly. For the sake of illustration, only one of the firing mechanism is described, although it is understood that the description applies identically to each of the other firing mechanisms. As shown in FIGS. 13 and 14, a firing mechanism consists of an elongate firing member 82 having a spherical nodule 83 formed on its lower extremity. The firing member 82 fits into a slot 84 having a widened lower channel 86 for receiving the nodule 83 of the firing member. The firing member 82 is retained in the slot 84 by means of a spring 88 and screw 90. The screw 90 is threaded into a cylindrical recess 91 formed in the slot 84. The screw 90 retains the spring 88 in the cylindrical recess against the firing member 82. The slot 84 widens near the periphery of the plate 100 into a pellet recess 92 which is provided for holding a pellet such as the pellet 93. An O-ring 95 retains the pellet in the recess 92 until the pellet is fired from the recess. The pellet recess 92 extends to the periphery of the plate 100 and receives a pellet from the pellet magazine 16 once each rotation of the rotatable barrel assembly 20. As shown, a cam surface 94 is formed in the rear interior of the breech block 14. The cam essentially consists of a ramp describing a partial spiral having a bottom at 96 and a top corresponding to a firing release point 98. In addition, a slight undercut recess 102 is provided which permits the firing member 82 to travel into the pellet recess 92.

In operation, when the rear plate 100 rotates in the direction of the arrow 103, the tip of the firing member 82 will initially engage the bottom of the cam ramp 96 at some time during rotation of the plate 100. As the plate continues to rotate, the firing member is moved in a cocking direction away from the pellet recess 92. When the recess 92 rotates under the magazine 16, the pellet 93 drops in. As the plate 100 rotates further, the firing member 82 travels to the firing release point 98. As the tip of the firing member 82 moves past the firing release point, the compressed spring 88 will suddenly expand, driving the firing member 82 against the pellet 93, thereby propelling the pellet through the barrel and out of the gun.

Obviously many modifications and variations are possible in light of these teachings and it is possible that the invention may be practiced other than as specifically taught.

I claim:

1. A projectile-firing toy gun of the gatling type, comprising:

a stationary support frame;

a rotatable barrel assembly including a circular array of substantially parallel barrels with an axial shaft, said circular array of barrels being mounted to rotate in said stationary support frame on said axial shaft;

a stationary firing position in said support frame adjacent said barrel assembly;

rotation means for rotating the barrel assembly such that each barrel is rotated past said firing position once each revolution of said barrel assembly;

a single, stationary firing means at said firing position, capable of being cocked and fired, for receiving and positioning a projectile at said firing position and for propelling said projectile into a barrel in response to a cocking and firing actuation sequence as said barrel is rotated past said firing position; and rotatable actuation means connected to said barrel assembly and acting between said barrel assembly and said firing means for effecting said cocking and firing actuation sequence as each barrel is rotated past said firing position.

2. The projectile-firing toy gun of claim 1 wherein said firing means comprises a single, stationary chamber for receiving and positioning said projectile, and a stationary firing mechanism adjacent said chamber with a reciprocated spring-actuated firing member, said firing mechanism having a first state in which said firing member is in an uncocked position, a second state in which said firing member is in a tensioned, cocked position, and a third state in which said firing member is released from said cocked position and driven by said firing mechanism against said projectile.

3. The projectile-firing toy gun of claim 2 wherein said actuating means includes a rotatable cam attached to said barrel assembly and a reciprocating cam follower acting between said rotatable cam and said firing mechanism for advancing said firing mechanism through said first, second, and third states in response to rotation of said cam with said barrel assembly.

4. The projectile-firing toy gun of claim 1 wherein said rotation means comprises a rotatable geared crank assembly attached to said support frame and a transfer gear attached to said axial shaft and in rotating geared engagement with said crank assembly.

5. A pellet-firing toy gun of the gatling type, comprising:

a stationary frame;

a rotatable barrel assembly rotatably mounted to said frame and having a plurality of substantially parallel barrels disposed in a substantially circular array;

a stationary firing position on said frame;

rotating means for rotating the barrel assembly such that each of said barrels is rotated past said firing position once each revolution of said barrel assembly;

actuating means connected to said rotatable barrel assembly for performing a cocking and firing actuation sequence as each barrel is rotated past said firing position; and a single, stationary firing means attached to said frame adjacent said firing position and in operable engagement with said actuating means for receiving and positioning a pellet at said firing position as each barrel is rotated past said firing position and responsive to said cocking and firing actuation sequence for cocking and then firing to propel a pellet into a barrel as said barrel is rotated past said firing position.

6. The pellet-firing toy gun of claim 5 wherein said firing means comprises a single, stationary chamber for receiving and positioning said pellet and a firing mechanism with a reciprocated spring-actuated firing member, and firing mechanism having a first state in which said firing member is in an uncocked position, a second state in which said firing member is in a tensioned, cocked position, and a third state in which said firing member is released from said cocked position and driven by said firing mechanism against said pellet.

7. The pellet-firing toy gun of claim 6 wherein said actuating means includes a rotatable cam attached to said barrel assembly in a location where said firing mechanism is located between said cam and said barrel assembly and a reciprocating cam follower attached to said firing mechanism for advancing said firing mechanism through said first, second, and third states in response to rotation of said cam with said barrel assembly.

8. The pellet-firing toy gun of claim 7 wherein said rotation means comprises a rotatable geared crank assembly attached to said support frame and a transfer gear attached to said axial shaft and in rotating geared engagement with said crank assembly.

9. A pellet-firing toy gun of the gatling type, comprising:

a stationary support frame;

a rotatable barrel assembly rotatably mounted on said frame and including a plurality of substantially parallel barrels disposed in a circular array about a central member;

rotating means for rotating said barrel assembly on said frame;

a plurality of chambers in said barrel assembly, each in communication with a respective one of said barrels and each for receiving and positioning a pellet;

a plurality of firing members on said barrel assembly, each said firing member comprising an elongate flexible material strip pivotally held adjacent a respective one of said chambers, said strip being moveable away from said barrel in a cocking direction to a predetermined firing release point;

a plurality of spring means, each for biasing a respective one of said strips toward said barrel assembly once said strip is moved in said cocking direction, and for driving said strip against a pellet in the chamber adjacent said strip when said strip is at said firing release point; and a stationary cam on said frame, adjacent said barrel assembly, and positioned for engaging and moving each of said firing members in said cocking direction to said release point.

* * * * *